US006976884B1

(12) United States Patent
Lee

(10) Patent No.: US 6,976,884 B1
(45) Date of Patent: Dec. 20, 2005

(54) SECURING DEVICE FOR THE ADAPTER OF A CABLE INTERMEDIATE CONNECTOR

(76) Inventor: Chun Te Lee, No. 61, Taiping Rd., North District, Taichung City 404 (TW)

( * ) Notice: Subject to any disclaimer, the term of this patent is extended or adjusted under 35 U.S.C. 154(b) by 0 days.

(21) Appl. No.: 11/086,356

(22) Filed: Mar. 23, 2005

(51) Int. Cl.[7] ..... H01R 33/92
(52) U.S. Cl. ..... 439/638; 439/546; 439/98; 439/939
(58) Field of Search ..... 439/98, 538, 539, 439/546, 551, 578, 628, 638, 939

(56) References Cited

U.S. PATENT DOCUMENTS 3,154,281 A * 10/1964 Frank ..... 248/201
5,667,409 A * 9/1997 Wong et al. ..... 439/654
5,769,661 A * 6/1998 Nealis ..... 439/551
6,146,208 A * 11/2000 Pennell ..... 439/675
6,688,916 B1 * 2/2004 Lee ..... 439/620
6,733,324 B1 * 5/2004 Lecsek et al. ..... 439/485
6,808,413 B2 * 10/2004 Plant et al. ..... 439/527
2004/0166728 A1 * 8/2004 Plant et al. ..... 439/527

* cited by examiner

*Primary Examiner*—Gary Paumen
*Assistant Examiner*—James R. Harvey
(74) *Attorney, Agent, or Firm*—Troxell Law Office, PLLC

(57) ABSTRACT

A securing device for the adapter of a cable intermediate connector includes a holder bored with a through hole formed with a circular hole and a non-circular hole. The holder has one sidewall provided with two projecting edges to be diametrically compressed and deformed toward the through hole. An adapter has its intermediate portion formed with a circular contact surface and a non-circular engage surface. When the adapter is inserted in the through hole of the holder, the circular contact surface can closely contact with the inner wall of the circular hole, and the non-circular engage surface can be closely engaged with the inner wall of the non-circular hole, and then the two projecting edges of the holder are compressed and deformed to press tight the non-circular engage surface and fix it inside the non-circular hole.

4 Claims, 4 Drawing Sheets

SECURING DEVICE FOR THE ADAPTER OF A CABLE INTERMEDIATE CONNECTOR

BACKGROUND OF THE INVENTION

1. Field of the Invention

This invention relates to a securing device for the adapter of a cable intermediate connector, particularly to one able to prevent the adapter of a cable intermediate connector from disengaging from a holder and also enhance the conductivity between the adapter member and the holder.

2. Description of the Prior Art

A conventional cable intermediate connector 10, as shown in FIGS. 1 and 2, includes a holder 11 and an adapter 12. The holder 11 has its lower opposite sides respectively extending downward and forming a wing 111 to be locked on a wall surface and its upper end bored with a through hole 112 for receiving the adapter 12 therein. The adapter 12 has its intermediate section formed with an engage portion 121 having its opposite ends respectively extending outward and forming a male connective head 122. The engage portion 121 of the adapter 12 has its outer circumferential surface formed with numerous axial elongate teeth 123 to be closely engaged with the inner wall of the through hole 112 of the holder 12 to fix the adapter 12 on the holder 11 when the adapter 12 is axially inserted in the through hole 112 of the holder 11. The two male connective head 122 of the adapter 12 are respectively and threadably connected with the female adapter of a cable (not shown). Further, the holder 11 has one side bored with a through hole 113 for the conductor 21 of a ground wire 20 to be inserted and fixed therein by a locking bolt 13 screwed from above so as to carry out grounding.

However, the holder 11 and the adapter 12 of the conventional cable intermediate connector 10 are made of different materials that may be affected by high and low temperature to expand and shrink to different extents; therefore, the holder 11 and the adapter 12 assembled together by mutual engagement are easily to be affected by high and low temperatures to cause expansion and shrinkage and likely to disengage from each other. In addition, the elongate teeth 123 of the central engage portion 121 of the adapter 12 and the inner wall of the through hole 112 of the holder 11 are linearly engaged with each other; therefore, the contact area between them is comparatively small and the conductivity between them becomes relatively low to affect grounding effect.

SUMMARY OF THE INVENTION

The objective of this invention is to offer a securing device for the adapter of the a cable intermediate connector, provided with a holder having a proper portion bored with a through hole having one end formed with a circular hole and the other end formed with a non-circular recessed groove. The holder has a proper sidewall provided with projecting edges to be compressed and deformed toward the through hole. An adapter member to be inserted in the through hole of the holder has its intermediate portion formed with a circular contact surface and a non-circular engage surface. When the adapter is inserted in the through hole of the holder, the circular contact surface of the adapter will closely contact with the inner wall of the circular hole of the holder, and the non-circular engage surface of the adapter will be closely engaged with the inner wall of the non-circular recessed groove of the holder. Then, the projecting edges of the holder are compressed and deformed toward the through hole to press tight the non-circular engage surface of the adapter and axially block and position it in the interior of the non-circular recessed groove of the holder. By so designing, the adapter can be firmly secured with the holder, impossible to rotate or shift or fall off. In addition, the adapter has its circular contact surface and non-circular engage surface respectively and closely engaged with the inner wall of the circular hole and the inner wall of the non-circular recessed groove of the holder, able to enlarge the contact area and enhance conductivity between the adapter and the holder so as to obtain an excellent effect in grounding.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
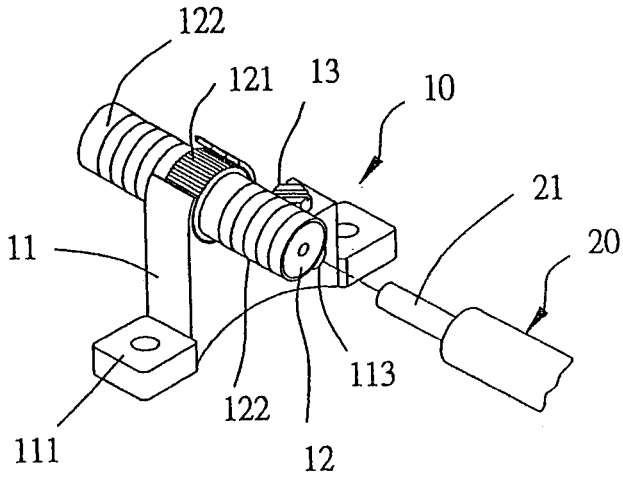
FIG. 1 PRIOR ART
FIG. 1 is a perspective view of a conventional cable intermediate connector.
Figure 2:
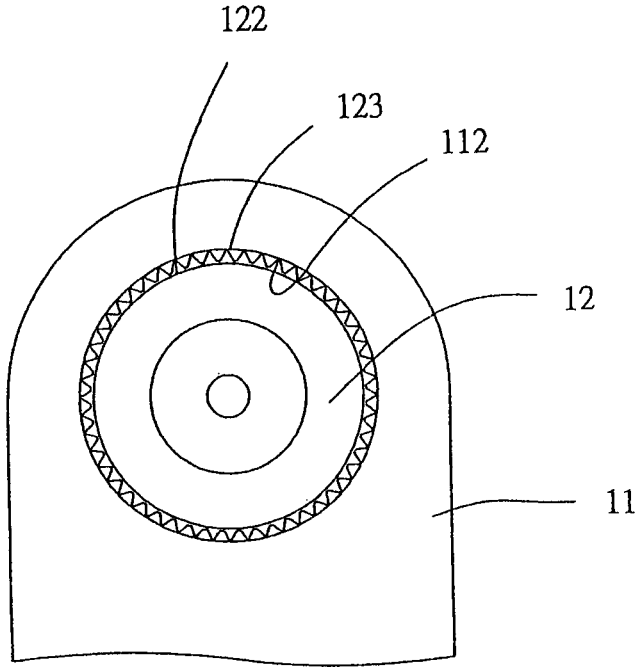
FIG. 2 PRIOR ART
FIG. 2 is a side cross-sectional view of the holder and the adapter of the conventional cable intermediate connector.
Figure 3:
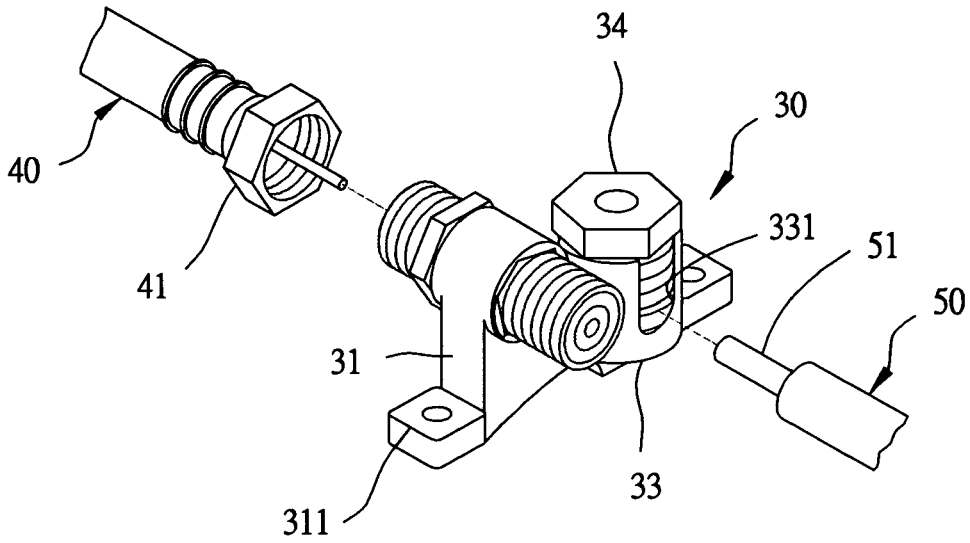
FIG. 3 is a perspective view of a first preferred embodiment of an intermediate connector in the present invention.
Figure 4:
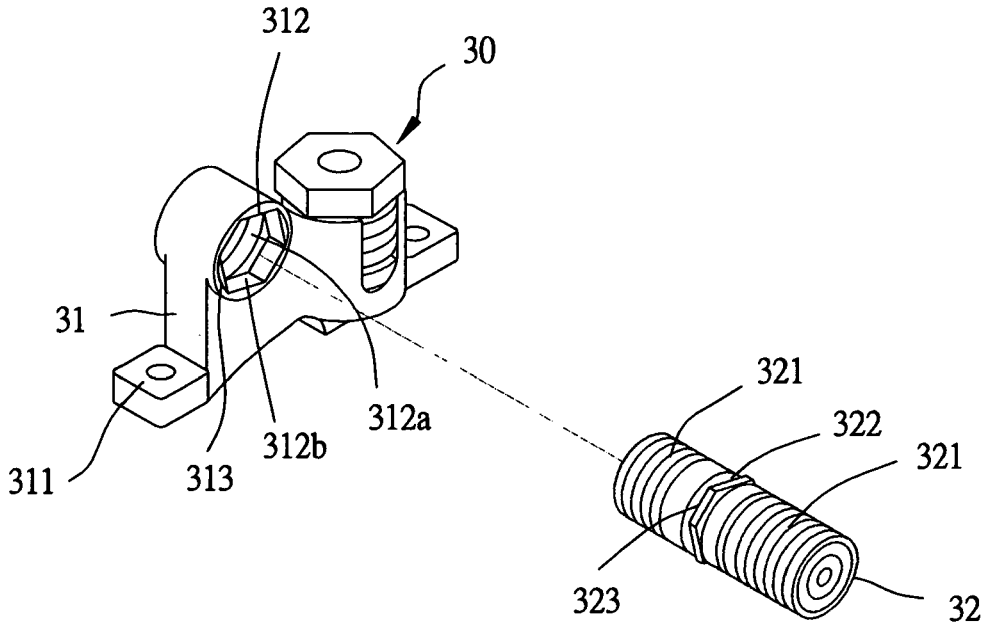
FIG. 4 is an exploded perspective view of the first preferred embodiment of the intermediate connector in the present invention.

A first preferred embodiment of a securing device for the adapter of a cable intermediate connector 30 in the present invention, as shown in FIGS. 3 and 4, includes a holder 31 and an adapter 32 combined together.

The holder 31 has its lower opposite sides respectively extending downward and forming a wing 311 to be locked on a wall surface. The adapter 32 is fitted in the upper portion of the holder 31, having its opposite ends respectively formed with a male connective head 321 to be threadably connected with the female adapter 41 of a cable 40. The holder 31 is provided at a proper location with a threaded base 33 having a grooved hole 331 for the conductor 51 of a ground wire 50 to be inserted and fixed therein by a tightening member 34 screwed from above to firmly clamp the conductor 51 in the threaded base 33.

The holder 31 has a proper upper portion bored with a through hole 312 having one side formed with a circular hole 312*a* and the other side bored with a polygonal hole 312*b* (a hexagonal hole in this preferred embodiment) and has one side wall opposed to the polygonal hole 312*b* provided with two symmetrical projecting edges 313 to be diametrically compressed and deformed toward the through hole 312 to carry out blocking and tightening.

The adapter 32 has its intermediate portion formed with a circular contact surface 322 having one side extending outward and forming a polygonal projecting engage surface 323 (a hexagonal engage surface in this preferred embodiment). Thus, after the adapter member 32 is inserted in the through hole 312 of the holder 31 through one corresponding side of the polygonal hole 312*b*, the circular contact surface 322 of the adapter 32 can closely contact with the inner wall of the circular hole 312*a* at one side of the through hole 312 of the holder 31, and the polygonal engage surface 323 of the adapter 32 can be closely engaged with the inner wall of the polygonal hole 312*b* at the other side of the through hole 312 of the holder 31. In addition, the two projecting edges 313 at one side of the holder 31 can be diametrically compressed and deformed toward the through hole 312 so as to press tight the polygonal engage surface 323 of the adapter 32 and axially block and fix it in the interior of the polygonal hole 312*b* of the holder 31, as shown in FIG. 5.

Figure 5:
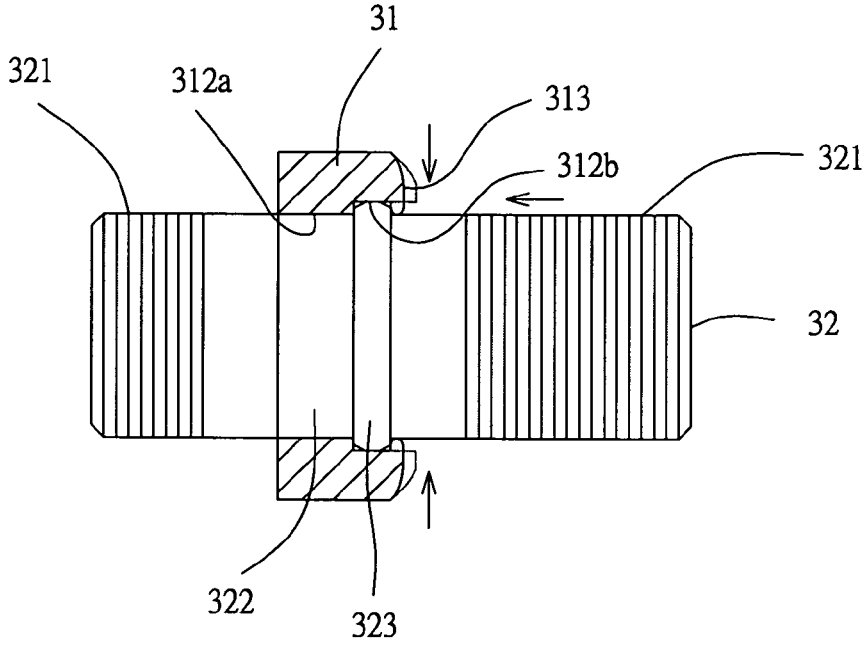
FIG. 5 is an upper cross-sectional view of the first preferred embodiment of the projecting edges of a holder compressed and deformed in the present invention.
Figure 6:
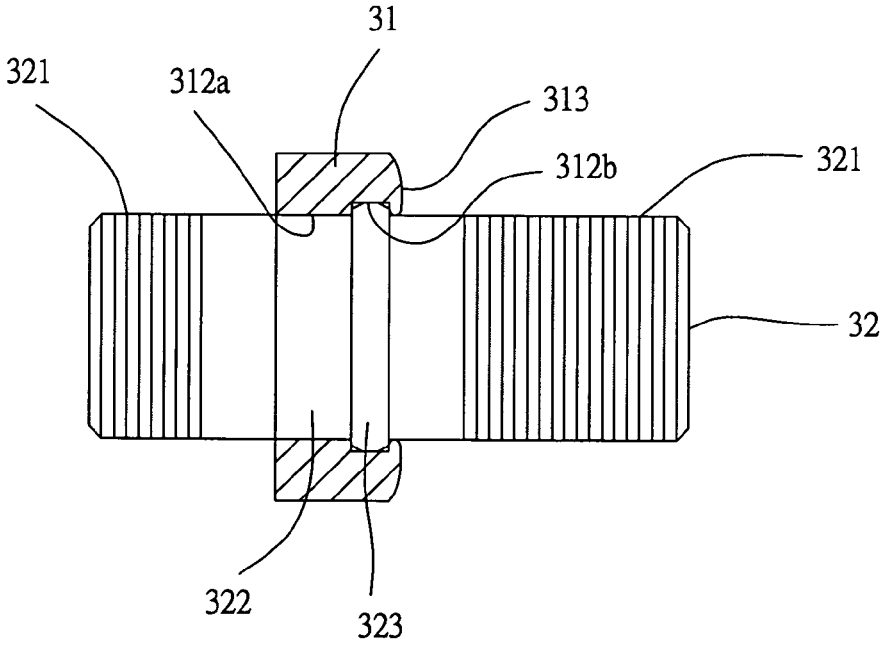
FIG. 6 is a partial upper cross-sectional view of the first preferred embodiment of the intermediate connector in the present invention.
Figure 7:
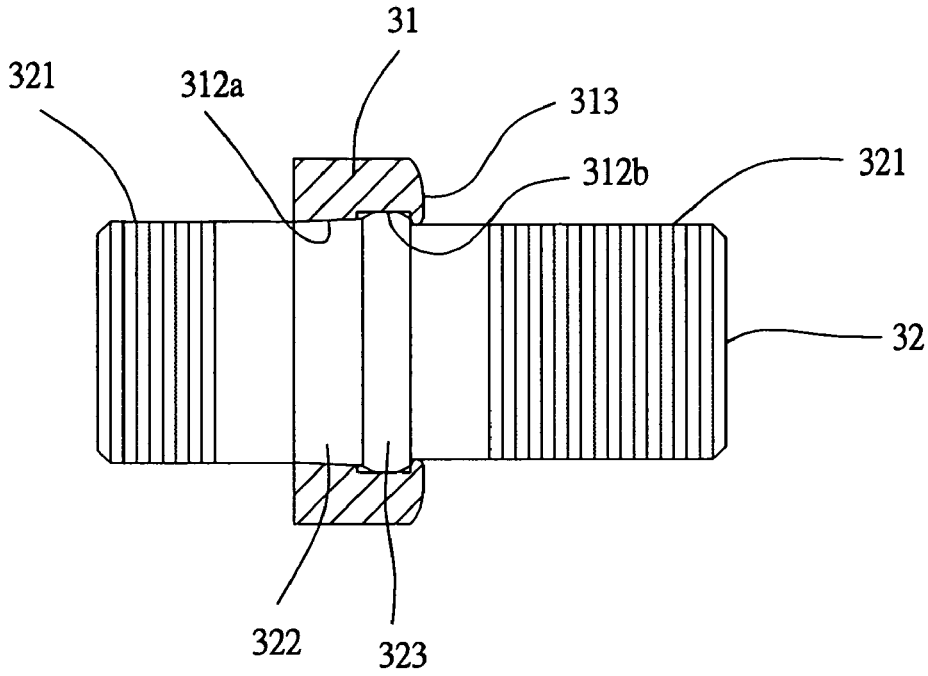
FIG. 7 is a side cross-sectional view of a second preferred embodiment of an intermediate connector in the present invention.

In assembling, as shown in FIG. 5, firstly, the adapter 32 has the corresponding end of the circular contact surface 322 inserted in the through hole 312 of the holder 31 through the corresponding end of the polygonal hole 312*b*, letting the circular contact surface 322 of the adapter 32 closely contact with the inner wall of the circular hole 312*a* at one side of the through hole 312, and the polygonal engage surface 323 engaged with the inner wall of the polygonal hole 312*b* at the other side of the through hole 312. Next, the two projecting edges 313 of the holder 31 are diametrically compressed and deformed toward the through hole 312 to press tight the polygonal engage surface 323 and axially block and fix it in the interior of the polygonal hole 312*b*, as shown in FIG. 6, thus securing the adapter 32 on the holder 31.

Specifically, the adapter 32 of the intermediate connector of this invention has its polygonal engage surface 323 firmly engaged with the inner wall of the polygonal hole 312*b* at one side of the through hole 312 of the holder 31, and the two projecting edges 313 of the holder 31 are diametrically compressed and deformed toward the through hole 312 to press tight the polygonal engage surface 323 of the adapter 32 and axially block and position it in the interior of the polygonal hole 312*b* of the holder 31. Therefore, the adapter 32 can be firmly secured with the holder 31, impossible to rotate or shift axially or fall off and able to always maintain a secure condition, no matter what the temperature may be. In addition, the adapter 32 has its polygonal engage surface 323 and its circular contact surface 322 respectively and closely contacting with the inner wall of the polygonal 312*b* and the inner wall of the circular hole 312*a* of the holder 31, able to enlarge the contact area and increase the conductivity between the adapter member 32 and the holder 31 to obtain an excellent effect in grounding.

Figure 8:
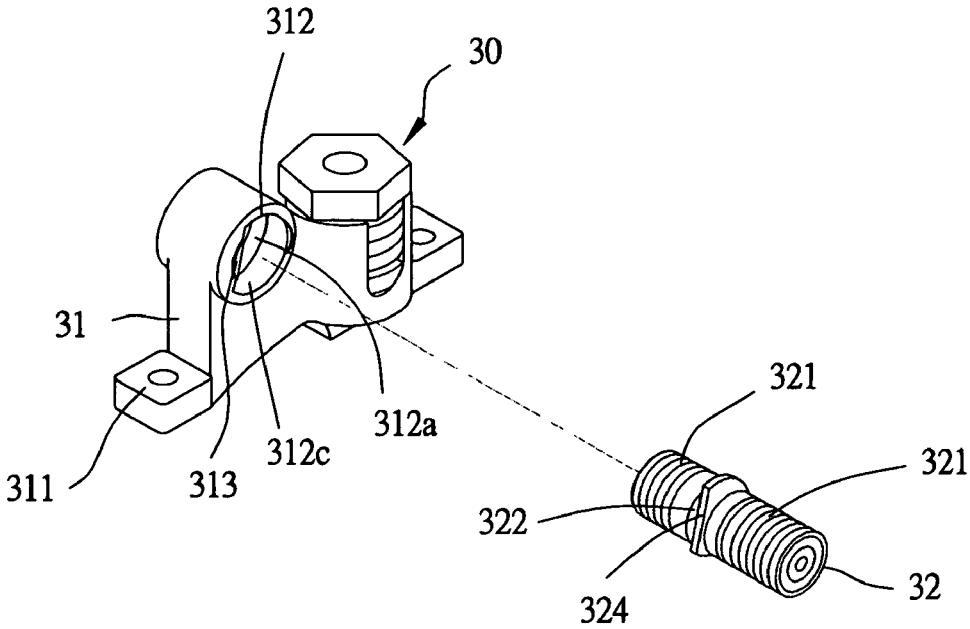
FIG. 8 is an exploded perspective view of a third preferred embodiment of an intermediate connector in the present invention.

A second preferred embodiment of a securing device for the adapter of a cable intermediate connector in the present invention, as shown in FIG. 8, has almost the same structure as that described in the first preferred embodiment, except that the circular hole 312*a* at one side of the through hole 312 of the holder 31 is shaped into a conical hole gradually shrinking from inside to outside, and the circular contact surface 322 at the intermediate portion of the adapter 32 is shaped into a conical surface matching with the conical hole 312*a*. Thus, when the adapter 32 is axially inserted in the through hole 312 of the holder 31, the conical contact surface 322 of the adapter 32 can closely be engaged with the inner wall of the conical hole 312*a* of the through hole 312, enabling the adapter 32 and the holder 31 to engage with each other comparatively closely to increase their contact area and enhance their conductivity to obtain an excellent effect in grounding.

A their preferred embodiment of a securing device for the adapter of a cable intermediate connector in the present invention, as shown in FIG. 8, has almost the same structure as that described in the first preferred embedment, except that a D-shaped hole 312*c* takes the place of the polygonal 312*b*, and a D-shaped engage surface 324 takes the place of the polygonal engage surface 323, equally able to secure the adapter 32 on the holder 31.

While the preferred embodiments of the invention have been described above, it will be recognized and understood that various modifications may be made therein and the appended claims are intended to cover all such modifications that may fall within the spirit and scope of the invention.

I claim:

1. A securing device for the adapter of a cable intermediate connector comprising a holder to be locked on a wall surface, said holder fitted therein with an adapter, said adapter having its opposite ends respectively formed with a male connective head to be threadably connected with the female adapter of a cable, a ground wire inserted and positioned in a proper portion of said holder: and characterized by, Said holder bored with a through hole in a proper upper portion, said through hole having one side formed with a circular hole and the other side formed with a non-circular hole, said holder provided with at least one projecting edge at one side wall opposite to said non-circular hole, said projecting edges diametrically compressed and deformed toward said through hole of the said holder for blocking and tightening: and Said adapter having its intermediate portion between said two male connective heads formed with a circular contact surface, said circular contact surface having one side provided with a non-circular engage surface, said circular contact surface of said adapter closely contacting with the inner wall of said circular hole at one side of said through hole after said adapter is inserted in said through hole of said holder, said non-circular engage surface of said adapter member closely engaged with the inner wall of said non-circular at the other side of said through hole after said adapter is inserted in said through hole of said holder, said projecting edge of said holder diametrically compressed and deformed toward said through hole to press and secure said non-circular engage surface, said projecting edges axially blocking and fixing said non-engage surface of said adapter in said non-circular hole of said holder.

2. The securing device for the adapter of a cable intermediate connector as claimed in claim 1, wherein said non-circular hole of said holder is a polygonal or a D-shaped hole, and said non-circular engage surface of said adapter is a polygonal or a D-shaped engage surface.

3. The securing device for the adapter of a cable intermediate connector as claimed in claim 1, wherein said holder is provided with two symmetrical projecting edges at one side wall opposite to said non-circular hole to be diametrically compressed and deformed toward said through hole.

4. The securing device for the adapter of a cable intermediate connector as claimed in claim 1, wherein said circular hole at one side of said through hole of said holder is a conical hole gradually shrinking from inside to outside, and said circular contact surface at the intermediate portion of said adapter member is a conical surface to be closely engaged with the inner wall of said conical hole.

* * * * *